US005738979A

United States Patent [19]

Fitterman et al.

[11] Patent Number: 5,738,979

[45] Date of Patent: Apr. 14, 1998

[54] BLACK-AND-WHITE DEVELOPMENT PROCESSING METHOD WITH REPLENISHMENT

[75] Inventors: Alan S. Fitterman; Franklin C. Brayer, both of Rochester; Joan F. Rachel, Penfield, all of N.Y.

[73] Assignee: Eastman Kodak Company, Rochester, N.Y.

[21] Appl. No.: 778,998

[22] Filed: Jan. 6, 1997

[51] Int. Cl.[6] ..... G03C 5/31

[52] U.S. Cl. ..... 430/399; 430/435; 430/436; 430/440; 430/446; 430/480; 430/483; 430/492

[58] Field of Search ..... 430/398, 399, 430/435, 436, 440, 446, 492

[56] References Cited

U.S. PATENT DOCUMENTS

| | | | |
|---|---|---|---|
| 5,210,010 | 5/1993 | Fielding | 430/466 |
| 5,236,816 | 8/1993 | Purol et al. | 430/492 |
| 5,376,510 | 12/1994 | Parker et al. | 430/466 |
| 5,389,502 | 2/1995 | Fitterman et al. | 430/491 |
| 5,503,965 | 4/1996 | Okutsu | 430/399 |
| 5,552,265 | 9/1996 | Bredoux et al. | 430/379 |

*Primary Examiner*—Hoa Van Le
*Attorney, Agent, or Firm*—J. Lanny Tucker

[57] ABSTRACT

A photographic silver halide element, such as a radiographic film, can be developed using a black-and-white developing solution containing an ascorbic acid developing agent. This solution is replenished with a replenisher solution of basically the same components but the amounts may be greater. Moreover, the replenisher solution pH is from 0.1 and up to 0.3 pH units higher than that of the developing solution. Both developing and replenisher solutions are free of hydroquinone. Replenishment can be carried out at relatively low rates with less impact on the environment without sacrificing sensitometric performance.

19 Claims, No Drawings

BLACK-AND-WHITE DEVELOPMENT PROCESSING METHOD WITH REPLENISHMENT

FIELD OF THE INVENTION

This invention relates in general to photography and in particular to an improved method for processing elements requiring black-and-white development. More particularly, this invention relates to an improved method of processing black-and-white radiographic films using specific developing solution replenishment requirements.

BACKGROUND OF THE INVENTION

Photographic developing compositions containing a silver halide developing agent are well known in the art for reducing silver halide grains containing a latent image to yield a developed photographic image. Many useful developing agents are known in the art, with hydroquinone and similar dihydroxybenzene compounds being some of the most common.

While dihydroxybenzenes (such as hydroquinone) generally provide development, with or without various known booster and nucleating compounds or auxiliary developing agents, they are disadvantageous from technical, ecological and environmental considerations.

The oxidation of hydroquinones also leads to higher pH which in turn leads to increased developer activity. Images can be thusly produced faster, so the processing time must be reduced. The net effect is less control of the process, and less desirable sensitometric properties in some processed materials.

In addition, hydroquinones have become of increasing concern in recent years because of potential environmental pollution.

Another class of developing agents described in several publications, including U.S. Pat. No. 5,236,816 (Purol et al), include ascorbic acid and various derivatives and salts thereof. Although developing compositions containing ascorbic acid generally place less oxygen demand on the environment, they generally have a higher pH (at least 9.5), and contain various components that can place more oxygen demand on the environment than desired.

In conventional photographic processing, replenishment of processing solutions, such as the developing solution, is used to compensate for exhaustion of components such as the developing agent, due to its oxidation in the air or by silver halide in the processed elements. This exhaustion is sometimes known in the art as "seasoning" of the processing solution. Developing solution replenisher solutions must be formulated to maintain high activity of the developer solution in the processing apparatus (that is, a processor). Typically, the replenishment volumes are high to help minimize the effects of seasoning.

In addition, current photographic technology utilizes developing solutions and developing solution replenishers with similar components and concentrations. A suitable replenishment rate allows for stable sensitometry as numerous photographic elements are processed, especially in what are known as "rapid access" methods and processors. Thus, rapid processing of many elements using the same developing solution is desired. Suitable replenishment composition and rates allow this to occur.

As noted above, ascorbic acid and similar compounds are known to readily oxidize so they lose activity in a short period of time. Over time, the pH of the developer solution drops until solution activity is negligible. One obvious approach to solving this problem is to increase the rate of replenishment.

However, there is great interest in the industry to reduce replenishment rates as much as possible so the costs of processing various photographic elements, such as radiographic films can be reduced, and less effluent is discharged to the environment. There are considerable cultural and political pressures for both goals to be met. Normally, these concerns cannot be addressed without sacrificing sensitometric results, which is a highly undesirable result especially in the health care field where important medical decisions are made based on the images provided in the processed radiographic elements.

Another known approach to minimize the loss of developing solution activity, besides increasing the replenishment rate, is to modify the replenisher solution itself. One such approach is described in U.S. Pat. No. 5,503,965 (Okutsu) wherein the replenisher solution is designed to have a higher pH than the developing solution in the processor. At a minimum, the replenisher solution has a pH of at least 0.3 pH unit higher than the starting developing solution, and preferred embodiments call for a pH of at least 0.5 unit higher. The developing solution is said to contain an ascorbic acid as a developing agent, and further has a mercapto- and hydroxy-substituted aromatic heterocycle to minimize silver stain when replenishment rates are reduced. Such developing solutions typically have a pH of from 8.5 to 12. Thus, the replenisher solution will have a pH typically from 8.8 to 12.3.

As noted above, ascorbic acid has insufficient stability, and the developing solution loses activity over time due to an increase in oxalic acid (or other small carboxylic acids) by-product concentration. Consequently, the pH drops. Obviously, a solution to this problem is to increase the pH of the developing solution by adding a replenisher having a higher pH as taught in the noted Okutsu patent.

However, it has been found that the use of replenisher solution having at least 0.3 higher pH is also disadvantageous. The higher pH replenisher solutions also lose activity, and cannot be readily maintained at the desired higher pH.

Another problem encountered with photographic processing is the deposition of silver metal in the processors from gradual seasoning of the processing solutions, especially developing solutions. When developing solution replenishment rates are reduced for environmental reasons, the silver metal deposition problem is magnified.

Thus, there is a need for low rate replenishment of developing solutions whereby silver metal deposition is minimized and developer solution activity is maintained for extended time.

SUMMARY OF THE INVENTION

The present invention overcomes the problems of the prior art with a method for processing comprising:

A) developing an imagewise exposed photographic silver halide element with an aqueous black-and-white developing solution that is free of dihydroxybenzene developing agents, the developing solution having a pH of from about 9 to about 11, and comprising:

a) an ascorbic acid developing agent, b) a 1-phenyl-3-pyrazolidone auxiliary super-additive co-developing agent, c) an organic antifoggant, d) a sulfite antioxidant present in an amount of at least 1:1 molar ratio compared to the ascorbic acid developing agent, e) a sequestering agent, and f) carbonate buffer present in an amount of at least 3:1 molar ratio compared to the ascorbic acid developing agent, and B) replenisher the black-and-white developing solution with an aqueous black-and-white replenisher solution, the replenisher solution having a pH that is at least 0.1 but less than 0.3 pH unit higher than the developing solution, the replenisher solution having:

the ascorbic acid developing agent at a concentration that is from 0 to about 50% more than in the developing solution, the co-developing agent at a concentration that is from 0 to about 50% more than in the developing solution, the organic antifoggant at a concentration that is from 0 to about 25% more than the developing solution, the sulfite antioxidant at a concentration that is from 0 to about 25% more than in the developing solution, and the sequestering agent at a concentration that is from 0 to about 25% more than in the developing solution.

The method of this invention can advantageously be used to process a wide variety of silver halide photographic elements, but black-and-white radiographic films are particularly processable with this invention. The method can be carried out in a variety of processor machines, and preferably in what are known as "rapid access" radiographic film processors.

The method of this invention provides a means for reducing the environmental concerns associated with the use of dihydroxybenzene developing agents, by means of using ascorbic acid type developing agents. In addition, the developing solution activity is suitably maintained with a replenisher solution that is essentially the same in composition and pH, but having a higher pH by only 0.1 to 0.3 pH unit. Moreover, the replenishment rates in the method are relatively low without the expected loss in sensitometric results, thereby reducing the impact on the environment.

Thus, advantages of this invention are numerous. The developing solution and replenisher solution contain no hydroquinone or similar dihydroxybenzene developing agents, and are therefore more compatible with the environment. The replenisher and developing solutions have essentially the same pH, and therefore have the same solution stability, compared to replenisher solutions having a higher pH which reduces their stability.

In addition, the replenisher solution contains suitable metal sequestering agents that significantly reduce the formation of silver sludge in the processor. The replenisher solution can be formulated in both aqueous and solid form due to its specific composition.

DETAILED DESCRIPTION OF THE INVENTION

The following details relate to the aqueous black-and-white developing solutions and aqueous black-and-white replenisher solutions useful in the method of this invention.

Ascorbic acid developing agents are described in a considerable number of publications in photographic processes, including U.S. Pat. No. 5,236,816 (noted above) and references cited therein. Useful ascorbic acid developing agents include ascorbic acid and the analogues, isomers and derivatives thereof. Such compounds include, but are not limited to, D or L-ascorbic acid, sugar-type derivatives thereof (such as sorboascorbic acid, γ-lactoascorbic acid, 6-desoxy-L-ascorbic acid, L-rhamnoascorbic acid, imino-6-desoxy-L-ascorbic acid, glucoascorbic acid, fucoascorbic acid, glucoheptoascorbic acid, maltoascorbic acid, L-arabosascorbic acid), sodium ascorbate, potassium ascorbate, isoascorbic acid (or L-erythroascorbic acid), and salts thereof (such as alkali metal, ammonium or others known in the art), endiol type ascorbic acid, an enaminol type ascorbic acid., a thioenol type ascorbic acid, and an enaminthiol type ascorbic acid, as described for example in U.S. Pat. No. 5,498,511 (Yamashita et al), EP-A-0 585,792 (published Mar. 9, 1994), EP-A-0 573,700 (published Dec. 15, 1993), EP-A-0 588,408 (published Mar. 23, 1994), WO 95/00881 (published Jan. 5, 1995), U.S. Pat. No. 5,089,819 and U.S. Pat. No. 5,278,035 (both of Knapp), U.S. Pat. No. 5,384,232 (Bishop et al), U.S. Pat. No. 5,376,510 (Parker et al), Japanese Kokai 7-56286 (published Mar. 3, 1995), U.S. Pat. No. 2,688,549 (James et al), U.S. Pat. No. 5,236,816 (noted above) and *Research Disclosure*, publication 37152, Mar. 1995. D-, L-, or D,L-ascorbic acid (and alkali metal salts thereof) or isoascorbic acid (or alkali metal salts thereof) are preferred. Sodium ascorbate and sodium isoascorbate are most preferred. Mixtures of these developing agents can be used if desired.

The developing composition of this invention also includes one or more auxiliary co-developing agents, which are also well known (e.g., Mason, *Photographic Processing Chemistry*, Focal Press, London, 1975).

Any auxiliary developing agent can be used, but the 3-pyrazolidone developing agents are preferred (also known as "phenidone" type developing agents). Such compounds are described, for example, in U.S. Pat. No. 5,236,816 (noted above). The most commonly used compounds of this class are 1-phenyl-3-pyrazolidone, 1-phenyl-4,4-dimethyl-3-pyrazolidone, 4-hydroxymethyl-4-methyl-1-phenyl-3-pyrazolidone, 5-phenyl-3-pyrazolidone, 1-p-aminophenyl-4,4-dimethyl-3-pyrazolidone, 1-p-tolyl-4,4-dimethyl-3-pyrazolidone, 1-p-tolyl -4-hydroxymethyl-4-methyl-3-pyrazolidone, and 1-phenyl-4,4-dihydroxymethyl-3-pyrazolidone. Other useful co-developing agents comprise one or more solubilizing groups, such as sulfo, carboxy or hydroxy groups attached to aliphatic chains or aromatic rings, and preferably attached to the hydroxymethyl function of a pyrazolidone, as described for example, in commonly assigned and copending U.S. Ser. No. 08/694,792 filed Aug. 9, 1996, by Roussihle et al. A most preferred co-developing agent is 4-hydroxymethyl-4-methyl-1-phehyl-3-pyrazolidone.

Less preferred auxiliary co-developing agents include aminophenols such as p-aminophenol, o-aminophenol, N-methylaminophenol, 2,4-diaminophenol hydrochloride, N-(4-hydroxyphenyl)glycine, p-benzylaminophenol hydrochloride, 2,4-diamino-6-methylphenol, 2,4-diaminoresorcinol and N-(beta-hydroxyethyl)-p-aminophenol.

A mixture of different types of auxiliary developing agents can also be used if desired.

Various organic antifoggants can be used in the practice of this invention, either singly or in admixture. Such compounds control the gross fog appearance in the processed elements. Suitable antifoggants include, but are not limited to, benzimidazoles, benzotriazoles, mercaptotetrazoles, indazoles and mercaptothiadiazoles. Representative antifoggants include 5-nitroindazole, 5-p-nitrobenzoylaminoimidazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-(2-merapto-1,3,4-thiadiazol-2-yl-thio)butanesulfonate, 5-amino-1,3,4-thiadiazol-2-thiol, 5-methylbenzotriazole, benzotriazole and 1-phenyl-5-mercaptotetrazole. Benzotriazole is most preferred.

The developing composition also includes one or more preservatives or antioxidants. Various conventional black-and-white preservatives can be used including sulfites. A "sulfite" preservative is used herein to mean any sulfur compound that is capable of forming or providing sulfite ions in aqueous alkaline solution. Examples include, but are not limited to, alkali metal sulfites, alkali metal bisulfites, alkali metal metabisulfites, amine sulfur dioxide complexes, sulfurous acid and carbonyl-bisulfite adducts. Potassium sulfite is preferred. Mixtures of these materials can also be used.

Examples of preferred sulfites include sodium sulfite, potassium sulfite, lithium sulfite, sodium bisulfite, potassium bisulfite, sodium metabisulfite, potassium metabisulfite and lithium metabisulfite. The carbonyl-bisulfite adducts that are useful include alkali metal or amine bisulfite adducts of aldehydes and bisulfite adducts of ketones. Examples of these compounds include sodium formaldehyde bisulfite, sodium acetaldehyde bisulfite, succinaldehyde bis-sodium bisulfite, sodium acetone bisulfite, β-methyl glutaraldehyde bis-sodium bisulfite, sodium butanone bisulfite, and 2,4-pentandione bis-sodium bisulfite.

Various known carbonate buffers can be included in the solutions to maintain the desired pH. Potassium or sodium carbonate is preferred in the practice of this invention. The pH of the developing solution is generally from about 9 to about 11, and preferably from about 9.5 to about 10.5. The replenisher solution pH would be generally in the same pH range, but from 0.1 up to but less than 0.3 pH unit higher.

It is also desirable that the black-and-white processing solutions described herein contain one or more sequestering agents that typically function to form stable complexes with free metal ions (such as silver ions) in solution. Many useful sequestering agents are known in the art, but particularly useful classes of compounds include, but are not limited to, multimeric carboxylic acids as described in U.S. Pat. No. 5,389,502 (Fitterman et al), aminopolycarboxylic acids, polyphosphate ligands, ketocarboxylic acids, and alkanolamines. Representative sequestering agents include ethylenediaminetetraacetic acid, diethylenetriaminepentaacetic acid, 1,3-propylenediaminetetraacetic acid, 1,3-diamino-2-propanoltetraacetic acid, ethylenediaminodisuccinic acid and ethylenediaminomonosuccinic acid.

The multimeric carboxylic acids are particularly useful in the practice of this invention. Such compounds are generally oligomers containing repeating units having the structure I:

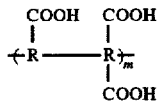

wherein R is alkylene of 2 to 4 carbon atoms, and m is an integer of 1 to 10. Such compounds usually have a molecular weight less than about 1000. A most preferred sequestering agent is diethylenetriaminepentaacetic acid. The effect of the use of the sequestering agent in the replenisher solution is a reduction in the deposition of silver.

The developing composition can contain other additives including various development restrainers, development accelerators, swelling control agents and stabilizing agents, each in conventional amounts. Examples of such optional components are described in U.S. Pat. No. 5,236,816 (noted above), U.S. Pat. No. 5,474,879 (Fitterman et al), Japanese Kokai 7-56286 and EP-A-0 585 792.

The essential components described above are present in the aqueous developing and replenisher solutions in the general and preferred amounts listed in Table I, all amounts being approximate. If formulated in dry form, the developing and replenisher compositions would have the essential components in amounts readily apparent to one skilled in the art suitable to provide the liquid concentrations.

TABLE I

| Component | General Amount | Preferred Amount |
|---|---|---|
| Ascorbic acid developing agent | 0.8–4 weight % | 2.0–3.5 weight % |
| Co-developing agent | 0.1–1 weight % | 0.15–0.3 weight % |
| Antifoggant | 0.001–0.1 weight % | 0.01–0.03 weight % |
| Sulfite antioxidant | at least 1:1 molar ratio to ascorbic acid | 1.5:1 to 3:1 molar ratio to ascorbic acid |
| Sequestering agent | 0.05–0.5 weight % | 0.3–0.5 weight % |
| Carbonate buffer | at least 3:1 molar ratio to ascorbic acid | 3.5:1 to 5.5:1 molar ratio to ascorbic acid |

The solutions useful in the method of this invention are prepared by dissolving the components in water and adjusting the pH to the desired value. The solutions can also be provided in concentrated form, and diluted to working strength just before use, or during use. The components of the solutions can also be provided in a kit of two or more parts to be combined and diluted with water to the desired strength and placed in the processor tanks or containers.

The developing and replenisher solutions described herein are useful for forming black-and-white silver images by development of light-sensitive silver halide photographic elements of various types including, but not limited to, radiographic films, microfilms, aerial films, black-and-white motion picture films, duplicating and copy films, and amateur and professional continuous tone black-and-white films. The method can also be used for the black-and-white development of color reversal films and papers. Preferably, radiographic films are processed using this invention.

The processed materials can have any suitable silver halide emulsion known for this purpose, the details of which are described in *Research Disclosure*, publication 36544, pages 501–541 (September 1994), and U.S. Pat. No. 5,384,232 (noted above). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). Preferred emulsions useful in the invention include silver bromide and silver bromoiodide emulsions (having up to 15 mol % iodide, based on total silver). Preferred emulsions for the radiographic films processed according to this invention include forehardened tabular grain emulsions as described for example, in U.S. Pat. No. 4,414,304 (Dickerson). These emulsions typically has thin tabular grains of predominantly silver bromide and up to about 15 mol % silver iodide. The grains generally have an average thickness of less than about 0.3 μmeters, and preferably, less than about 0.2 μmeters. The grains are dispersed in forehardened colloids as described in the noted patent. The emulsions can also contain the conventional addenda for providing various coating and sensitometric properties, including but not limited to sensitizing dyes, infrared opacifying dyes, stabilizers, antifoggants, antikinking agents, latent-image stabilizers and the like.

In some embodiments, the radiographic films can also include a thiaalkylene bis(quaternary ammonium) salt in at least one layer. These compounds, also known as Quadt salts, increase imaging speed by acting as development accelerators.

In processing the photographic elements described herein, the time and temperature for development can be varied widely. Typically, the temperature will be in the range of from about 20° to about 50° C., and the time will be for less than 90 seconds for radiographic films, but can be longer for other types of elements. More preferably, the development temperature can be in the range of from about 30° to about 40° C., and the development time at from about 5 to about 40 seconds for radiographic films.

Processing can be carried out in any suitable processor for a given type of photographic element. For example, for radiographic films, the method can be carried out using the processor described in U.S. Pat. No. 3,545,971 (Barnes et al). One suitable processor is sold by Eastman Kodak Company under the trademark X-OMAT.

In most instances, the processed element is a film sheet, but it can also be a continuous element. Each element is bathed in a processing solution for a suitable period of time.

The replenisher solution useful in this invention is designed to maintain the activity and pH of the developing solution as constant as possible. The components of the replenisher solution are essentially the same as those in the working developing solution, but the amounts in the replenisher solution may be different for one or more components. The following Table II lists the general and preferred concentrations in the replenisher solution compared to the working developing solution.

TABLE II

| Component | General Amount | Preferred Amount |
|---|---|---|
| Ascorbic acid developing agent | 0–50% more | 25–40% more |
| Co-developing agent | 0–50% more | 5–15% more |
| Antifoggant | 0–25% more | 10–15% more |
| Sulfite antioxidant | 0–25% more | 5–15% more |
| Sequestering agent | 0–25% more | 5–15% more |
| Carbonate buffer | sufficient to provide from 0.1 & up to 0.3 higher pH | sufficient to provide at least 0.1 to 0.25 higher pH |

The rate of replenishment for the developing solution is at least 130 ml/m$^2$, and preferably from about 160 to about 320 ml/m$^2$. One advantage of this invention is the relatively lower developer replenishment rates that can be used. For radiographic films that come in sheet form, typically having dimensions of 14×17 inches (35.6×43.2 cm), the replenishment rate is generally less than about 70 ml/sheet, preferably from about 20 to about 70 ml/sheet, and more preferably from about 25 to about 50 ml/sheet.

Following development, black-and-white photographic materials can then be processed with one or more additional steps that are known in the art using conventional processing solutions. Such additional steps include development stop, fixing, washing and drying. The *Research Disclosure* publication, noted above, describes the components of such processing solutions. Typical fixing solutions include a fixing agent, such as a thiosulfate or thioether, and one or more low pH buffers and sequestering agents. Suitable fixing times and temperatures can be used. Color reversal materials can be processed after black-and-white development according to this invention, using conventional steps and processing solutions.

After fixing, the photographic elements are generally washed to remove silver salts dissolved by fixing, at suitable times and temperatures.

Processing according to the present invention can be carried out using conventional tanks, trays and automated processing machines holding processing solutions. As noted above, radiographic films are preferably processed using conventional "rapid access" radiographic processing equipment.

The following examples are provided to illustrate the practice of this invention, and are not meant to be limiting in any manner. All percentages are by weight unless otherwise indicated.

Examples 1–3

Two developing solutions and three replenisher solutions useful in the present invention were used to process several samples of several types of radiographic black-and-white photographic films. The compositions of these solutions were as follows:

TABLE III

DEVELOPING SOLUTIONS

| COMPONENT | SOLUTION A | SOLUTION B |
|---|---|---|
| ascorbic acid | 25 g/l | 17 g/l |
| 4-hydroxymethyl-4-methyl-1-phenyl-3-pyrazolidone | 2.4 g/l | 2.2 g/l |
| potassium sulfite | 48 g/l | 40 g/l |
| potassium carbonate | 100 g/l | 100 g/l |
| benzotriazole | 0.2 g/l | 0.18 g/l |
| sequestering agent* | 1–3 g/l | 1–3 g/l |
| pH | 10.20 | 10.20 |

TABLE IV

REPLENISHER SOLUTIONS

| COMPONENT | SOLUTION C | SOLUTION D | SOLUTION E |
|---|---|---|---|
| ascorbic acid | 35 g/l | 35 g/l | 18.0 g/l |
| 4-hydroxymethyl-4-methyl-1-phenyl-3-pyrazolidone | 2.6 g/l | 2.7 g/l | 2.3 g/l |
| potassium sulfite | 50 g/l | 50 g/l | 42 g/l |
| potassium carbonate | 100 g/l | 100 g/l | 100 g/l |
| benzotriazole | 0.21 g/l | 0.26 g/l | 0.2 g/l |
| sequestering agent* | 1–3 g/l | 1–3 g/l | 1–3 g/l |
| pH | 10.3 | 10.3 | 10.25 |

*Diethylenetriaminepentaacetic acid

Sheets (14×17 inches or 35.6×43.2 cm) of seven commercially available radiographic films (from Eastman Kodak Company) were exposed using a conventional sensitometer having a twenty-one step exposure. They were then processed with the solutions noted above and a conventional X-OMAT fixing solution in a conventional KODAK 270RA processor using a black-and-white development temperature of 34.4° C. for about 26 seconds. A conventional RP X-OMAT Fixer and Replenisher solution was used at 32° C. for 26 seconds, followed by normal water washing at 10° C. for 26 seconds and drying.

The eight films processed and evaluated were T-MAT G/RA radiographic film ("TMG/RA"), T-MAT J/RA radiographic film ("TMJ/RA"), T-MAT L/RA radiographic film ("TML/RA"), T-MAT IEF/RA radiographic film ("IEF/RA"), T-MAT EB/RA radiographic film ("EB/RA"), T-MAT S/RA radiographic film ("TMS/RA"), INSIGHT RA radiographic film ("IT/RA") and MinR 2000 radiographic film ("MR2000").

The following Table V shows the solutions and replenishment rates used for each method of this invention.

TABLE V

| | EXAMPLE 1 | EXAMPLE 2 | EXAMPLE 3 |
|---|---|---|---|
| Developing solution | A | A | B |
| Replenisher solution | C | D | E |
| Replenishment rate as ml/sheet (or ml/m$^2$) | 65 (423) | 30 (195) | 65 (423) |

Each processed film sheet was evaluated by calculating conventional density vs. log E (D log E) characteristic curves. The speed (CR) of such films was inversely related to the exposure required to produce a given effect. In these examples, the speed was determined by the exposure required to produce a density of 1.00 above the base plus fog of the film. Base plus fog is the optical density of the film, plus the density of the emulsion layers in areas that have not been intentionally exposed. Gross fog (GF) is defined as the film density from factors other than radiation used for imaging. Film contrast is related to the slope or steepness of the characteristic curves. In these examples, the calculation of film contrast (CT) was obtained from the slope of the characteristic curves between the density of 1.00 and 0.25 above the base plus fog density. Dmax (UDP) is a measure of the highest optical density for an exposed and processed film strip. Lower scale contrast (LSC) was calculated from the slope of the characteristic curve between a density of 0.85 above the base plus fog density and −0.03 log E. Upper scale contrast (USC) was calculated from the slope of the characteristic curves between the densities of 2.85 and 1.50 above base plus fog density.

The following Tables VI, VII and VIII list the sensitometric data obtained for Examples 1, 2 and 3, respectively. The tables show data using "fresh" developing solution as well as the solution after 3 months of replenishment ("finish" or "final").

TABLE VI

| FILM | | GF | CR | CT | LSC | UDP |
|---|---|---|---|---|---|---|
| TMG/RA | fresh | 0.23 | 442 | 3.23 | 2.15 | 3.69 |
| TMG/RA | finish | 0.26 | 445 | 3.07 | 2.10 | 3.77 |
| TMG/RA | fresh | 0.22 | 441 | 3.03 | 2.14 | 3.55 |
| TMG/RA | finish | 0.25 | 443 | 2.88 | 2.08 | 3.49 |
| TML/RA | fresh | 0.25 | 435 | 2.18 | 1.77 | 3.33 |
| TML/RA | finish | 0.28 | 438 | 2.15 | 1.75 | 3.36 |
| TMJ/RA | fresh | 0.26 | 431 | 2.45 | 1.91 | 3.55 |
| TMJ/RA | finish | 0.34 | 435 | 2.34 | 1.82 | 3.58 |
| IT/RA | fresh | 0.26 | 421 | 1.62 | 1.12 | 3.61 |
| IT/RA | finish | 0.33 | 425 | 1.63 | 1.20 | 3.73 |
| MinR 2000 | fresh | 0.27 | 412 | 3.56 | 2.43 | 3.20 |
| MinR 2000 | finish | 0.21 | 416 | 3.25 | 2.32 | 3.20 |

TABLE VII

| FILM | | GF | CR | CT | LSC | UDP | USC |
|---|---|---|---|---|---|---|---|
| TMG/RA | seasoned | 0.25 | 439 | 2.78 | 2.03 | 2.57 | 3.49 |
| TMG/RA | final | 0.22 | 436 | 3.02 | 2.11 | 2.71 | 3.48 |
| TMG/RA | seasoned | 0.26 | 442 | 2.95 | 2.06 | 2.92 | 3.54 |
| TMG/RA | final | 0.22 | 436 | 3.02 | 2.11 | 2.71 | 3.48 |
| TMJ/RA | seasoned | 0.32 | 429 | 2.17 | 1.77 | 2.10 | 3.35 |
| TMJ/RA | final | 0.27 | 423 | 2.20 | 1.78 | 2.02 | 3.25 |
| TML/RA | seasoned | 0.26 | 436 | 2.24 | 1.78 | 2.08 | 3.23 |
| TML/RA | final | 0.23 | 429 | 2.26 | 1.83 | 1.94 | 3.16 |
| TMS/RA | seasoned | 0.25 | 438 | 2.66 | 2.07 | 1.67 | 3.06 |
| TMS/RA | final | 0.23 | 433 | 2.66 | 2.09 | 1.48 | 3.01 |
| EB/RA | seasoned | 0.24 | 414 | 2.39 | 1.92 | 2.34 | 3.79 |
| EB/RA | final | 0.23 | 412 | 2.32 | 1.97 | 1.99 | 3.59 |
| IT/RA | seasoned | 0.32 | 413 | 1.53 | 1.09 | 2.23 | 3.44 |
| IT/RA | final | 0.24 | 409 | 1.51 | 1.07 | 2.18 | 3.30 |
| IEF/RA | seasoned | 0.21 | 402 | 2.64 | 1.94 | 2.91 | 3.41 |
| IEF/RA | final | 0.20 | 397 | 2.66 | 1.97 | 2.87 | 3.35 |

TABLE VIII

| FILM | | GF | CR | CT | LSC | UDP |
|---|---|---|---|---|---|---|
| TMG/RA | fresh | 0.26 | 444 | 2.75 | 2.01 | 3.55 |
| TMG/RA | final | 0.25 | 439 | 2.78 | 2.03 | 3.49 |
| TMG/RA | fresh | 0.28 | 447 | 2.98 | 2.10 | 3.70 |
| TMG/RA | final | 0.26 | 442 | 2.95 | 2.06 | 3.54 |
| TMJ/RA | fresh | 0.34 | 433 | 2.20 | 1.79 | 3.47 |
| TMJ/RA | final | 0.32 | 429 | 2.17 | 1.77 | 3.35 |
| TML/RA | fresh | 0.28 | 440 | 2.25 | 1.80 | 3.32 |
| TML/RA | final | 0.26 | 436 | 2.24 | 1.78 | 3.23 |
| TMS/RA | fresh | 0.26 | 443 | 2.69 | 2.08 | 3.17 |
| TMS/RA | final | 0.25 | 438 | 2.66 | 2.07 | 3.06 |
| IT/RA | fresh | 0.33 | 420 | 1.58 | 1.13 | 3.60 |
| IT/RA | final | 0.32 | 413 | 1.53 | 1.09 | 3.44 |
| IEF/RA | fresh | 0.22 | 408 | 2.56 | 1.91 | 3.48 |
| IEF/RA | final | 0.21 | 402 | 2.64 | 1.94 | 3.41 |

The results listed in Tables VI and VIII indicate that runs carried out using two different developing/replenisher systems using typical replenishment rates showed acceptable speed, contrast and Dmax ("UDP") relative to "fresh" or starting conditions. Fog was somewhat higher than usual, but under normal conditions, speed usually decreases slightly with seasoning of developing solution.

The data in Table VII show that at a preferred replenishment rate (30 ml/sheet), acceptable fog, speed, contrast and Dmax were obtained for the "seasoned" state of developing solution relative to "fresh" or starting conditions.

EXAMPLE 4

Comparative Example

A processing method similar to that of this invention was carried out (Control) using the teaching of U.S. Pat. No. 5,503,965 (noted above) whereby the replenishing solution had a pH that was at least 0.3 units higher than the pH of the developing solution in the processor. Table IX shows the developing solution used in this comparison:

TABLE IX

| DEVELOPING SOLUTION | |
|---|---|
| COMPONENT | CONTROL* |
| ascorbic acid | 40 g/l |
| Phenidone | 5.0 g/l |
| sodium sulfite | 15.0 g/l |

TABLE IX-continued

| DEVELOPING SOLUTION | |
|---|---|
| COMPONENT | CONTROL* |
| potassium carbonate | 55.2 g/l |
| 5-methylbenzotriazole | 0.06 g/l |
| potassium bromide | 2.0 g/l |
| sequestering agent** | 4.0 g/l |
| pH | 10.4 |

*FUJI DR-K Developing solution
**Diethylenetriaminepentaacetic acid

The replenishing solution used for the Control method was commercially available FUJI Development Replenisher G having a pH of 11.0, which is more than 0.5 pH unit above the pH of the developing solution.

Sheets (10×12 inches or 25.4×30.5 cm) eleven commercially available radiographic films (from Eastman Kodak Company and Fuji Photo Film Company) were exposed using a conventional sensitometer having a twenty-one step exposure. They were then processed with the solutions noted above and a conventional X-OMAT fixing solution in a conventional KODAK 270RA processor using a black-and-white development temperature of 35° C. for about 45 seconds, followed by normal water washing and drying.

The six KODAK radiographic films processed and evaluated were T-MAT G/RA 591 and 9414 radiographic films ("TMG/RA"), T-MAT J/RA radiographic film ("TMJ/RA"), T-MAT L/RA radiographic film ("TML/RA"), T-MAT IEF/RA radiographic film ("IEF/RA"), T-MAT S/RA radiographic film ("TMS/RA"), and T-MAT H/RA radiographic film ("TMH/RA"). The five FUJI radiographic films processed and evaluated were 73101 ("HRHA"), 70402 ("HRHA30"), 95603 ("HRA30"), 20121 ("HRS30") and 34109 ("HRC") radiographic films.

The development and fixing replenishment rates for the Control method was 20 ml/sheet (equivalent to 40 ml/14×17 inch sheet).

The following Table X lists the sensitometric data obtained for each processed film:

TABLE X

| FILM | | GF | CR | CT | LSC | USC | UDP |
|---|---|---|---|---|---|---|---|
| TMG/RA 591 | fresh | 0.35 | 448 | 2.61 | 1.91 | 2.33 | 3.49 |
| TMG/RA 591 | final | 0.22 | 442 | 3.25 | 2.20 | 3.44 | 3.72 |
| TMG/RA 9414 | fresh | 0.33 | 449 | 2.67 | 1.94 | 2.56 | 3.54 |
| TMG/RA 9414 | final | 0.21 | 440 | 3.17 | 2.16 | 3.35 | 3.63 |
| TML/RA | fresh | 0.37 | 437 | 1.81 | 1.59 | 1.31 | 3.11 |
| TML/RA | final | 0.24 | 436 | 2.26 | 1.79 | 2.30 | 3.38 |
| TMJ/RA | fresh | 0.40 | 434 | 1.98 | 1.71 | 1.57 | 3.23 |
| TMJ/RA | final | 0.26 | 433 | 2.45 | 1.92 | 2.40 | 3.44 |
| TMH/RA | fresh | 0.39 | 470 | 2.61 | 1.96 | 1.55 | 3.43 |
| TMH/RA | final | 0.23 | 465 | 3.25 | 2.23 | 3.05 | 3.61 |
| TMS/RA | fresh | 0.35 | 445 | 2.24 | 1.87 | — | 3.00 |
| TMS/RA | final | 0.24 | 441 | 2.90 | 2.15 | 1.95 | 3.27 |
| HRHA | fresh | 0.28 | 470 | 2.83 | 2.00 | 2.58 | 3.22 |
| HRHA | final | 0.22 | 463 | 2.30 | 1.98 | 1.56 | 3.36 |
| HRHA30 | fresh | 0.33 | 470 | 2.72 | 1.95 | 2.78 | 3.34 |
| HRHA30 | final | 0.23 | 460 | 2.34 | 1.92 | 1.50 | 3.22 |
| HRA30 | fresh | 0.29 | 451 | 2.76 | 1.93 | 3.39 | 3.55 |
| HRA30 | final | 0.22 | 440 | 2.33 | 1.90 | 2.00 | 3.36 |
| HRS30 | fresh | 0.29 | 444 | 2.45 | 1.82 | 1.48 | 3.17 |
| HRS30 | final | 0.22 | 433 | 2.18 | 1.78 | 1.68 | 3.17 |
| HRC | fresh | 0.29 | 449 | 1.92 | 1.59 | 1.33 | 3.15 |
| HRC | final | 0.21 | 442 | 1.85 | 1.54 | 1.66 | 3.22 |

The data in Table X indicate large differences in speed and contrast when both KODAK and FUJI radiographic films were processed using the Control method. Speed loss was as high as 9 "CR", and contrast was almost 0.7 higher after developing solution seasoning ("final") compared to when the developing solution was fresh.

The invention has been described in detail with particular reference to preferred embodiments thereof, but it will be understood that variations and modifications can be effected within the spirit and scope of the invention.

We claim:

1. A method for processing comprising:

A) developing an imagewise exposed photographic silver halide element with an aqueous black-and-white developing solution that is free of dihydroxybenzene developing agents, said developing solution having a pH of from about 9 to about 11, and comprising:

a) an ascorbic acid developing agent in an amount of from about 0.8 to about 4 weight percent, b) a 1-phenyl-3-pyrazolidone auxiliary co-developing agent, c) an organic antifoggant, d) a sulfite antioxidant present in an amount of at least 1:1 molar ratio compared to said ascorbic acid developing agent, e) a sequestering agent, and f) carbonate buffer present in an amount of from 3.5:1 to 5.5:1 molar ratio compared to said ascorbic acid developing agent, and B) replenishing said black-and-white developing solution with an aqueous black-and-white replenisher solution at a rate of from about 130 to about 320 ml/m$^2$, said replenisher solution having a pH that is from 0.1 to 0.25 pH unit higher than said developing solution, said replenisher solution having:

said ascorbic acid developing agent at a concentration that is from 0 to about 50% more than in said developing solution, said co-developing agent at a concentration that is from 0 to about 50% more than in said developing solution, said organic antifoggant at a concentration that is from 0 to about 25% more than said developing solution, said sulfite antioxidant at a concentration that is from 0 to about 25% more than in said developing solution, and said sequestering agent at a concentration that is from 0 to about 25% more than in said developing solution.

2. The method of claim 1 wherein step A is carried out for from about 5 to about 40 seconds.

3. The method of claim 1 wherein said replenisher solution comprises:

said ascorbic acid developing agent at a concentration that is from 25 to 40% higher than in said developing solution, said co-developing agent at a concentration that is from 5 to 15% higher than in said developing solution, said organic antifoggant at a concentration that is from 10 to 15% higher than in said developing solution, said sulfite antioxidant at a concentration that is from 5 to 15% higher than in said developing solution, and said sequestering agent at a concentration that is from 5 to 15% higher than in said developing solution.

4. The method of claim 1 wherein said photographic element is a black-and-white photographic film.

5. The method of claim 4 wherein said photographic element is a radiographic film.

6. The method of claim 5 wherein said radiographic film comprises a forehardened tabular grain emulsion.

7. The method of claim 6 wherein said tabular grain emulsion comprises silver bromoiodide grains with less than 15 mol % silver iodide, said grains having an average thickness of less than about 0.3 μm.

8. The method of claim 1 wherein said developing step is followed by a fixing step.

9. The method of claim 1 wherein said photographic element is a color reversal film.

10. The method of claim 1 wherein said ascorbic acid developing agent is D-,L- or D,L-ascorbic acid, said co-developing agent is 4-hydroxymethyl-4-methyl-1-phenyl-3-pyrazolidone, said organic antifoggant is benzotriazole, said sulfite antioxidant is potassium sulfite, said sequestering agent is diethylenetriaminepentaacetic acid, and said carbonate buffer is potassium or sodium carbonate.

11. The method of claim 1 wherein said sequestering agent is a multimeric carboxylic acid.

12. The method of claim 1 wherein said developing and replenisher solutions independently have a pH of from about 9.5 to about 10.5.

13. The method of claim 1 wherein said element is a radiographic sheet film.

14. The method of claim 13 wherein said developing solution is replenished at a rate of from about 20 to about 70 ml/sheet.

15. The method of claim 14 wherein said developing solution is replenished at a rate of from about 25 to about 50 ml/sheet.

16. The method of claim 1 wherein said developing solution has the following component concentrations:

from 0.8 to 4 weight % of said ascorbic acid developing agent, from 0.1 to 1 weight % of said co-developing agent, from 0.001 to 0.1 weight % of said antifoggant, and from 0.05 to 0.5 weight % of said sequestering agent.

17. The method of claim 1 wherein said developing solution comprises said sulfite antioxidant in an amount of a 1.5:1 to 3:1 molar ratio to said ascorbic acid developing agent.

18. The method of claim 1 wherein said developing solution has the following component concentrations:

from 2 to 3.5 weight % of said ascorbic acid developing agent, from 0.15 to 0.3 weight % of said co-developing agent, from 0.01 to 0.03 weight % of said antifoggant, 1.5:1 to 3:1 molar ratio of said sulfite antioxidant to said ascorbic acid developing agent, and from 0.3 to 0.5 weight % of said sequestering agent.

19. The method of claim 1 wherein said developing solution is replenished at a rate of from about 160 to about 320 $ml/m^2$.

* * * * *